US008277340B1

(12) United States Patent
Devine

(10) Patent No.: US 8,277,340 B1
(45) Date of Patent: Oct. 2, 2012

(54) BASKETBALL TRAINING DEVICE

(76) Inventor: Anthony Devine, Bristol, PA (US)

( * ) Notice: Subject to any disclaimer, the term of this patent is extended or adjusted under 35 U.S.C. 154(b) by 0 days.

(21) Appl. No.: 12/782,695

(22) Filed: May 18, 2010

(51) Int. Cl.
*A63B 69/00* (2006.01)

(52) U.S. Cl. ..... 473/447; 473/422

(58) Field of Classification Search ..... 473/422, 473/433, 438, 446–448, 441, 444, 445; D21/781, D21/635
See application file for complete search history.

(56) References Cited

U.S. PATENT DOCUMENTS

| | | | | | |
|---|---|---|---|---|---|
| 3,552,749 | A | | 1/1971 | Piggotte | |
| 3,675,921 | A | * | 7/1972 | Meyers, Sr. | 473/448 |
| 4,489,940 | A | * | 12/1984 | Amundson | 473/446 |
| 4,989,862 | A | * | 2/1991 | Curtis | 473/448 |
| D321,370 | S | * | 11/1991 | Curtis | D19/62 |
| 5,160,138 | A | * | 11/1992 | Sanders | 473/438 |
| 5,333,865 | A | * | 8/1994 | Holmes | 273/317.5 |
| 5,485,993 | A | * | 1/1996 | Lipsett | 473/448 |
| D370,242 | S | * | 5/1996 | Bright | D21/781 |
| 5,527,185 | A | | 6/1996 | Davis | |
| 5,800,291 | A | * | 9/1998 | Grover | 473/447 |
| 5,816,951 | A | * | 10/1998 | Hudock | 473/447 |
| 5,890,985 | A | * | 4/1999 | Jenney | 473/447 |
| D539,373 | S | * | 3/2007 | Cook | D21/781 |
| 7,258,633 | B2 | * | 8/2007 | Joseph et al. | 473/433 |
| 7,618,334 | B2 | * | 11/2009 | Bridge et al. | 473/422 |
| 7,658,689 | B2 | * | 2/2010 | Crook, II | 473/447 |
| 7,736,247 | B2 | * | 6/2010 | Caruso | 473/444 |
| 8,152,660 | B1 | * | 4/2012 | Jimenez et al. | 473/450 |
| 2007/0225089 | A1 | | 9/2007 | Jones | |
| 2011/0092317 | A1 | * | 4/2011 | Burgess | 473/417 |

* cited by examiner

*Primary Examiner* — Mitra Aryanpour
(74) *Attorney, Agent, or Firm* — LaMorte & Associates P.C.

(57) ABSTRACT

A basketball training device that mimics an opposing player during practice. The training device has a weighted base set on caster wheels. A vertical support extends upwardly from the base. A slide structure moves up and down on the vertical support between a high position and a low position. A blocking form is coupled to the slide structure. The blocking form moves with the slide structure. Consequently, the blocking form can move up and down. An elongated control rod attaches to the wheeled base. The control rod is used by a coach to push and pull the training device along the basketball court during play. In this manner, a coach can adjust the position of the blocking form to better mimic the movements of a real opposing player.

17 Claims, 4 Drawing Sheets

BASKETBALL TRAINING DEVICE

BACKGROUND OF THE INVENTION

1. Field of the Invention

In general, the present invention relates to devices that are used to train players to better play the game of basketball. More particularly, the present invention relates to devices that present a false opponent or other obstacle on a basketball court.

2. Prior Art Description

Basketball is a well known sport that requires many different skills to play well. For example, players need ball shooting skills, ball dribbling skills, and ball passing skills, just to name a few. Many of the required skills can be practiced by a lone player. However, many others cannot.

Basketball is a team sport. Thus, practicing passing and executing plays requires more than one player. Furthermore, in a real game of basketball, two teams play against each other. Thus, basketball is really a two team sport. Consequently, teams not only have to practice plays with teammates, they have to practice those plays while being challenged by the players of an opposing team.

Shooting, dribbling and passing a basketball around opposing players are skills that must be practiced. However, they are usually the skills that are practiced least. Often a basketball coach does not have enough players to field two opposing teams for practice. Furthermore, the coach himself may lack the physical abilities needed to personally challenge a gifted player during practice.

It is for these reasons that many coaches use training devices to help develop player skills. In basketball, there have been developed many different training devices that are intended to simulate an opposing player. These training devices typically come in the form of a dummy that can be wheeled onto a basketball court. Players can then practice dribbling, shooting and passing around the dummy form. Such prior art training devices are exemplified by U.S. Pat. No. 5,527,185 to Davis, entitled Athletic Training Device, U.S. Pat. No. 3,552,749 to Piggotte, entitled Basketball Practice Aid, and U.S. Patent Application Publication No. 2007/0225089 to Jones, entitled Man-like Dummy Player Figure As A Practicing Tool For Basketball Training.

Although such dummy forms may have height adjustments and wheels that enable the dummy figures to be wheeled into place, the dummy forms are otherwise static during basketball practice. Since the dummy forms do not move during practice, they are not very realistic and therefore have limited value. A practice dummy form would be far more useful if it were more representative of a real player. For instance, if the dummy form could move quickly around a basketball court, change orientation and change height on the move to better exemplify a jumping opponent, it would be a more effective practice tool.

A need therefore exists for a dummy form for mimicking a basketball player that is self-supporting, yet can be moved quickly during play to affect play. The need also exists for a mobile dummy form that can be quickly changed in height to mimic a jumping opponent during play. In this manner, the dummy figure can more realistically mimic the actions of a real opposing player. These needs are met by the present invention as described and claimed below.

SUMMARY OF THE INVENTION

The present invention is a basketball training device that mimics an opposing player during practice. The training device has a weighted base. A plurality of caster wheels support the base on a basketball court. This enables the base to be rolled in any direction on the basketball court. A vertical support extends upwardly from the base.

A slide structure is provided that engages the vertical support. The slide structure moves up and down on the vertical support between a high position and a low position. A blocking form is coupled to the slide structure. The blocking form moves with the slide structure relative the vertical support. Consequently, as the slide structure moves between the high position and the low position, the blocking form also moves up and down.

At least one handle is coupled to the slide structure for manually moving the slide structure between the high position and the low position. An optional spring may be provided to bias the slide structure into some predetermined position.

An elongated control rod attaches to the wheeled base. The control rod is used by a coach to push and pull the training device along the basketball court during play. In this manner, a coach can adjust the position of the blocking form to better mimic the movements of a real opposing player.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention training device can be embodied in many ways, the embodiment illustrated shows the device shaped as a torso with up reaching arms. This embodiment is selected in order to set forth one of the best modes contemplated for the invention. The illustrated embodiment, however, is merely exemplary and should not be considered a limitation when interpreting the scope of the appended claims. It will be understood that alternate embodiments may be shaped to have lower torsos and legs. Likewise, the arms can be oriented in different positions.

Figure 1:
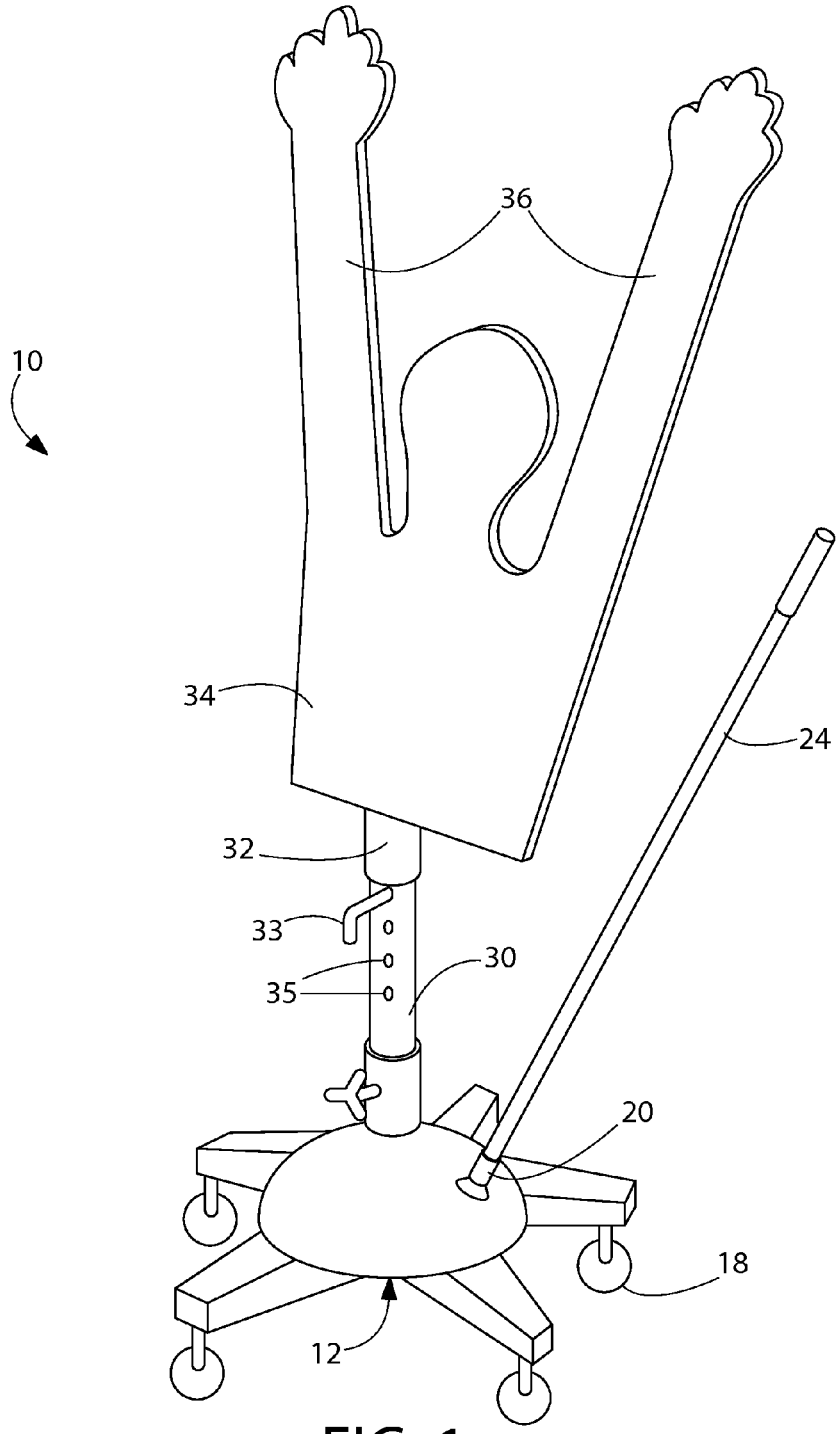
FIG. 1 is a perspective view of an exemplary embodiment of a basketball training device.
Figure 2:
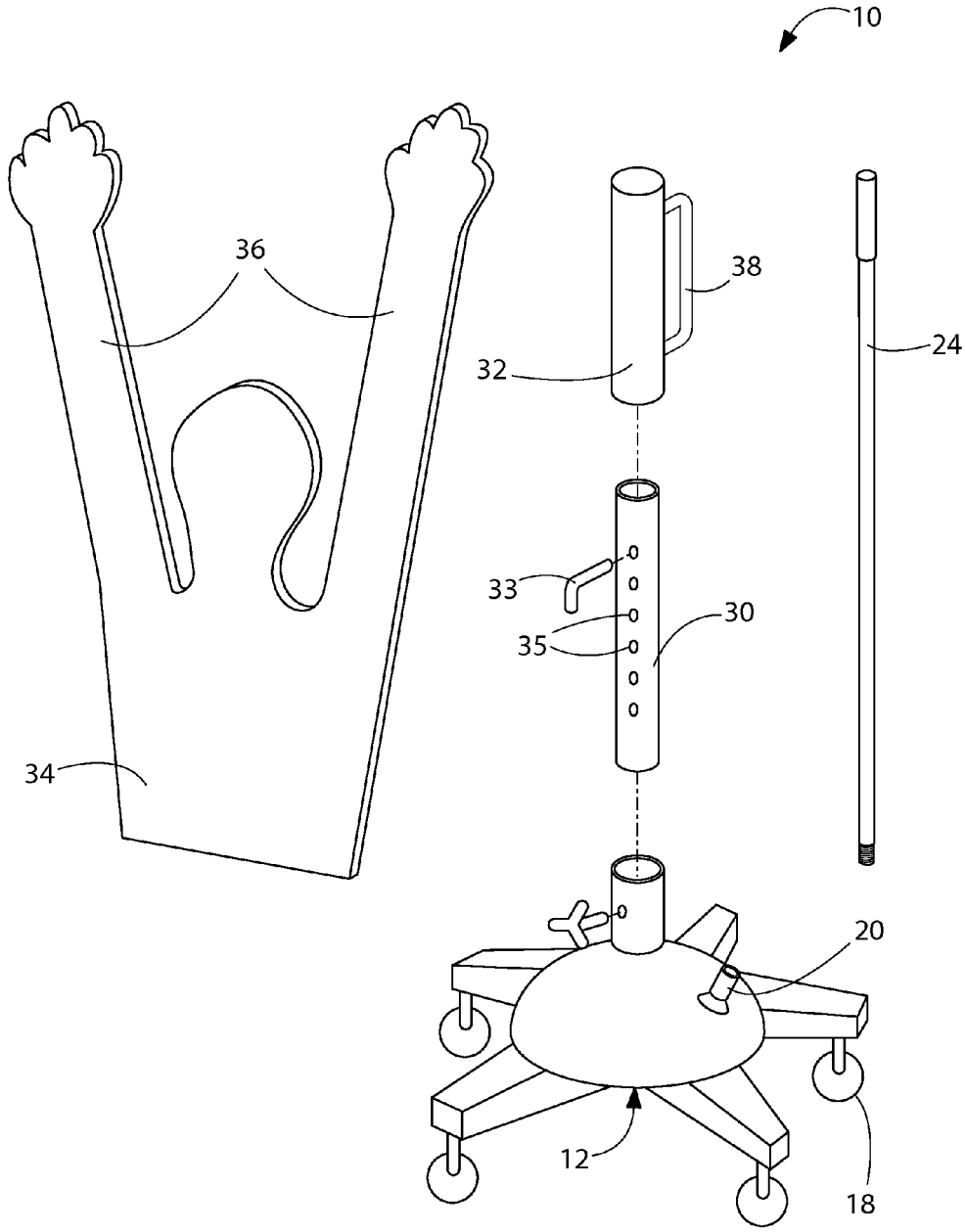
FIG. 2 is an exploded view of the embodiment of FIG. 1.
Figure 3:
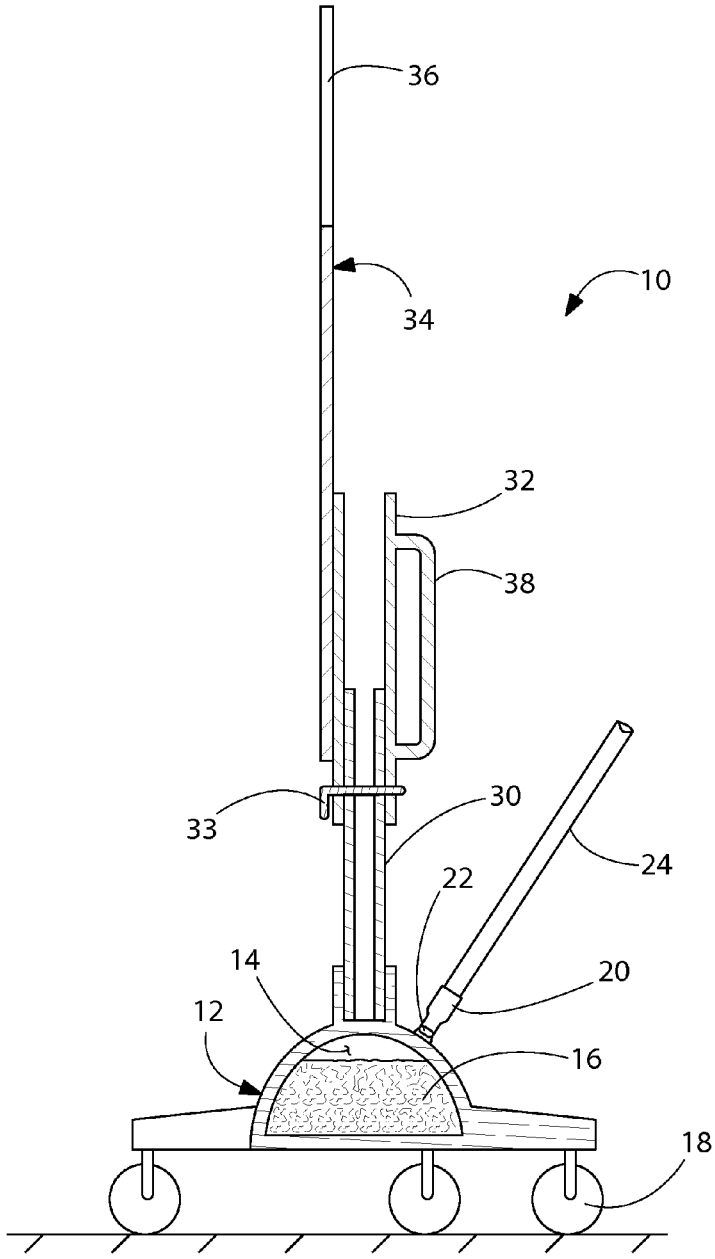
FIG. 3 is a cross-sectional view of the embodiment of FIG. 1.

Referring to FIG. 1 in conjunction with both FIG. 2 and FIG. 3, an exemplary embodiment of the training device 10 is shown. The training device 10 has a base 12. The base 12 can be weighted to provide the overall training device with a low center of gravity. Within the base 12 is an internal chamber 14. The internal chamber 14 can be filled with sand, water, or other heavy ballast 16. The width of the base 12 and the center of gravity are preferably engineered in ratio so that the training device 10 can be tipped to an angle of at least forty degrees without falling over.

The base 12 is supported by a plurality of wheels 18. The wheels 18 are preferably caster wheels that can turn in any direction. This enables the base 12 to be free rolling in any direction in which it is pushed or pulled. In the shown embodiment, five wheels 18 are used. It should be understood that any plurality of wheels greater than three can be utilized to support the base 12.

At least one control rod receptacle 20 is provided. The control rod receptacle 20 is shown mounted to the base 12.

However, the control rod receptacle 20 can be mounted to higher elements above the base 12. The control rod receptacle 20 can be rigidly mounted. However, in the shown embodiment, the control rod receptacle 20 is mounted using a universal joint 22. The universal joint 22 enables the control rod receptacle 20 to be selectively moved into different orientations relative the base 12.

A control rod 24 is provided. The control rod 24 can be of a fixed length. However, in the shown embodiment, the control rod 24 has a telescoping configuration that enables the length of the control rod 24 to be selectively adjusted within a predetermined range. The preferred range for the control rod 24 is between six feet and twelve feet. The minimum length of the control rod 24 is four feet.

The control rod 24 has a connector 26 at one end and a handle 28 at the opposite end. The connector 26 on the control rod 24 is received by the control rod receptacle 20. Once interconnected, the control rod 24 can be used to push and pull the base 12. Consequently, a person holding the handle 28 at the opposite end of the control rod 24 can quickly roll the base 12 in any desired direction by either pushing or pulling on the control rod 24.

A vertical support 30 extends upwardly from the center of the base 12. The vertical support 30 preferably has a length of between three feet and five feet. The vertical support 30 moves with the base 12 and remains in its vertical orientation regardless of the direction in which the base 12 is rolled. An adjustment pin 33 is provided that passes through one of a set of holes 35 formed in the vertical support.

A tubular slide structure 32 is provided that rides along at least a portion of the vertical support 30. The tubular slide structure 32 is capable of reciprocally moving up and down along the vertical support 30 between a low position and an elevated position. The low position is determined by the position of the adjustment pin 33 extending through the vertical support 30.

A silhouette form 34 is attached to the tubular slide structure 32. The silhouette form 34 shown is in the shape of a player's torso with arms 36 raised overhead. Such a silhouette shape is preferred, but other shapes can be used. The silhouette form 34 can be made of many material, such as plywood. However, plywood is stiff. It is preferred that the silhouette form 34 be flexible. In this manner, the up-stretched arms 36 can bend in a wide range of angles. This enables a player to practice shooting and passing a basketball through the arms of a defender. This could not be done if the arms were fabricated from stiff wood. However, it has been found that a sheet of high density polyethylene at least 3/16ths of an inch thick works well in mimicking the resistance provided by a real defender.

Since the silhouette form 34 is affixed to the tubular slide structure 32, it will be understood that the silhouette form 34 will rise and fall as the tubular slide structure 32 moves up and down the vertical support 30 between the low position and the elevated position. It will therefore be understood that the maximum height of the up-stretched arms 36 can be raised and lowered by the movement of the tubular slide structure 32 on the vertical support 30.

At least one handle 38 is affixed to the tubular slide structure 32. The handle 38 enables a person to grasp the tubular slide structure 32 and manually move it either up or down on the vertical support 30.

The training device 10 is used for a variety of basketball training activities. For shooting training, a coach grasps the training device 10 by the handles 38 on the tubular slide structure 32. By pushing and pulling the handles 38, the base 12 can be quickly wheeled to anywhere within the reach of the coach. The coach can therefore quickly reposition the training device 10 to remain a foot or two in front of the basketball player as the basketball player moves to take a shot. Just as the basketball player takes a shot, the coach can lift the handles 38 upwardly. This will lift the tubular slide structure 32 and the silhouette form 34, thus simulating an opposing player jumping to block a shot. Since the arms 36 of the silhouette form 34 are flexible, they can bend, should the basketball strike the arms 36 during the shot.

For dribbling and passing practice, a coach attaches the control rod 24 to the base 12 of the training device 10. From any distance away, the coach can roll the training device 10 back and forth in front of a dribbling or passing player to mimic the real moves of a defender. However, since the coach is doing this from a fixed position, the coach can run numerous drills without the coach becoming fatigued.

Figure 4:
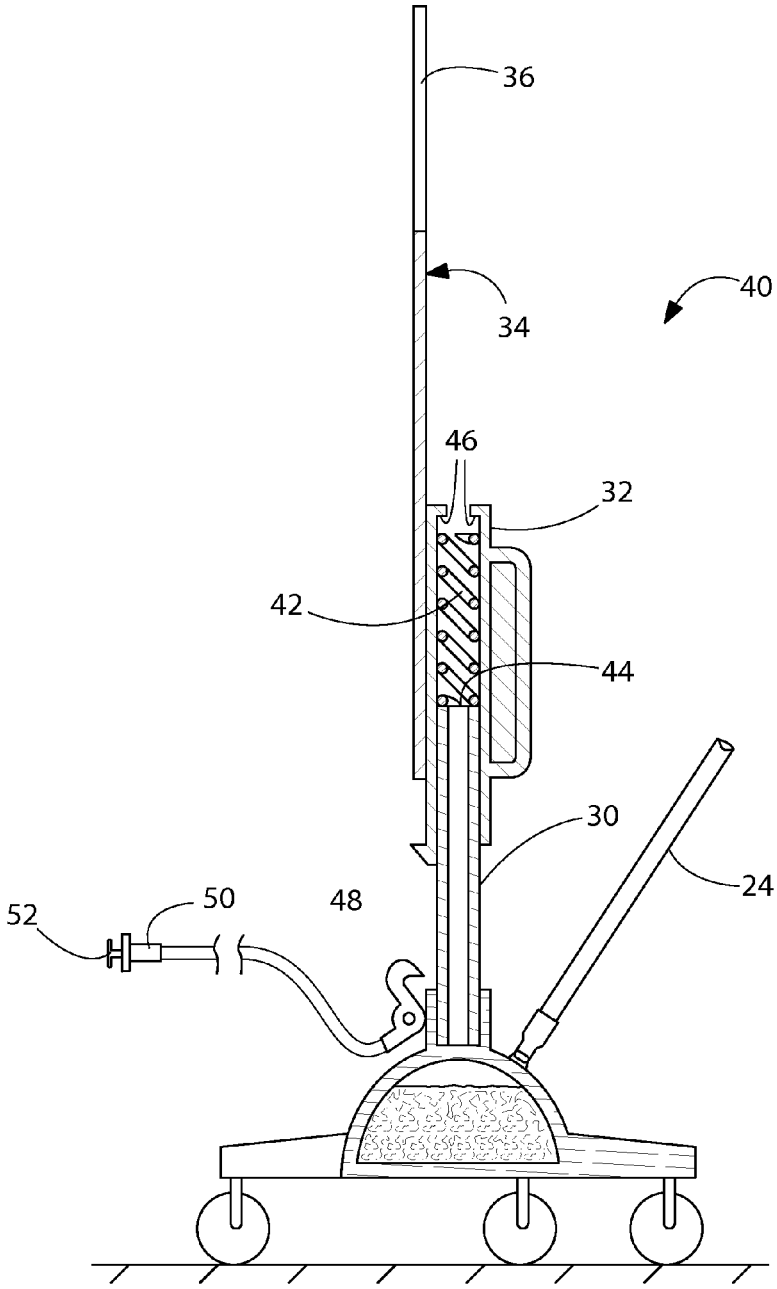
FIG. 4 is a cross-sectional view of an alternate embodiment of a basketball training device.

Referring now to FIG. 4, an alternate embodiment of the present invention training device 40 is shown. This second embodiment shares many features with the first embodiment. To avoid confusion, the same reference numbers will be used to describe like parts. In this embodiment, a spring 42 is provided between the vertical support 30 and the tubular slide structure 32. The spring 42 is a coil spring that becomes compressed between the top 44 of the vertical support 30 and stops 46 on the tubular slide structure 32 when the tubular slide structure 32 is pressed down on the vertical support 30 to its lowest point of travel.

A latch 48 is provided that engages the tubular slide structure 32 when it is at its lowest point. The latch 48, when engaged, holds the tubular slide structure 32 in place against the bias of the compressed spring 42. The latch 48 can be released either manually or by remote control. In the shown embodiment, the latch 48 is released by a cable trigger 50 with a push activation knob 52 at its far end. The cable trigger 50 can be attached to the control rod 24 so that activation knob 52 is positioned near the handle 28 of the control rod 24.

During practice, a coach presses the tubular slide structure 32 down until it engages the latch 48. This compresses the spring 42. The training device 40 is actively rolled around a basketball court by a coach pushing and pulling the control rod 24. When the coach thinks that a player is about to take a shot, the coach presses the activation knob 52 and releases the latch 48. With the latch 48 released, the spring 42 is free to expand. The energy released by the spring 42 causes the tubular slide structure 32 to rapidly move upward. The silhouette form 34 attached to the tubular slide structure 32 also moves upwardly. As a result, the silhouette form 34 appears to jump up.

It will therefore be understood that the present invention training device 40 can be used to simulate a defender who jumps up when a player is making a shot.

The two embodiments of the present invention that are illustrated and described are merely exemplary. It should therefore be understood that a person skilled in the art can make many variations to those embodiments. For instance, the shape of the silhouette form 34 can be altered in many ways, as can the shape of the base 12. Furthermore, the illustrated tubular slide structure 32 is intended to be exemplary of any slide structure 32 capable of traveling up and down a vertical support 30. All such embodiments are intended to be included within the scope of the present invention as defined by the claims.

What is claimed is:

1. A basketball training device, comprising:

a base;

a plurality of caster wheels supporting said base, therein enabling said base to be rolled in any direction;

a vertical support extending upwardly from said base;

a slide structure having a front surface and a rear surface, wherein said vertical support extends through said slide structure between said front surface and said rear surface, therein enabling said slide structure to freely move up and down on said vertical support between a high position and a low position;

a blocking form coupled to said front surface of said slide structure, wherein said blocking form moves with said slide structure relative said vertical support, wherein said blocking form is shaped to depict at least a portion of a basketball player having up-stretched arms; and an elongated control rod coupled to said base at a connection joint, wherein said elongated control rod enables a person to manually cause said base to roll on said plurality of caster wheels by pushing and pulling on said elongated control rod;

a handle extending from said rear surface of said slide structure, wherein said handle enables a person to manually move said slide structure up and down on said vertical support between said high position and said low position as said base rolls on said plurality of caster wheels.

2. The device according to claim 1, wherein said control rod is at least four feet in length.

3. The device according to claim 1, wherein said control rod is coupled to said base with a universal joint.

4. The device according to claim 1, wherein said low position and said high position are at least eighteen inches apart.

5. The device according to claim 1, further including a spring contacting both said slide stricture and said vertical support.

6. The device according to claim 5, wherein said spring is compressed when said slide structure is in said low position.

7. The device according to claim 6, further including a latch for temporarily retaining said slide structure in said low position in opposition of said spring, wherein said spring launches said slide structure from said low position to said high position when said latch is released.

8. The device according to claim 1, wherein said blocking form is a planar silhouette.

9. The device according to claim 8, wherein said up-stretched arms are flexible.

10. The device according to claim 1, wherein said base contains an internal chamber that holds ballast.

11. A basketball training device, comprising:

a base;

a plurality of caster wheels supporting said base that enable said base to be rolled in any direction;

a vertical support extending upwardly from said base;

a tubular slide structure having a front surface and a rear surface that moves along said vertical support, wherein said vertical support extends through said slide structure between said front surface and said rear surface, and said slide structure is capable of freely moving up and down on said vertical support between a high position and a low position;

a blocking form coupled to said front surface of said slide structure, said blocking form being shaped into at least a portion of a basketball player having up-stretched arms, wherein said blocking form moves with said slide structure relative said vertical support; and at least one handle extending from said rear surface of said slide structure for manually moving said slide structure between said high position and said low position while said base is rolling on said wheels.

12. The device according to claim 11, further including an elongated control rod extending from said base, wherein said control rod has a length of at least four feet.

13. The device according to claim 12, wherein said control rod is coupled to said base with a universal joint.

14. The device according to claim 11, further including a spring contacting both said slide structure and said vertical support.

15. The device according to claim 11, wherein said spring is compressed when said slide structure is in said low position.

16. The device according to claim 15, further including a latch for temporarily retaining said slide structure in said low position in opposition of said spring, wherein said spring launches said slide structure from said low position to said high position when said latch is released.

17. The device according to claim 11, wherein said blocking form is configured as a planar silhouette.

* * * * *